United States Patent [19]

Bohme et al.

[11] Patent Number: 4,623,412

[45] Date of Patent: Nov. 18, 1986

[54] RESIN IMPREGNATED BOARD

[75] Inventors: Reinhard D. Bohme, Minneapolis; Steven D. Overholt, Eagan, both of Minn.

[73] Assignee: Champion International Corporation, Stamford, Conn.

[21] Appl. No.: 768,935

[22] Filed: Aug. 26, 1985

Related U.S. Application Data

[63] Continuation of Ser. No. 605,662, Apr. 30, 1984, abandoned.

[51] Int. Cl.[4] ..... B31F 1/28; B05D 1/36

[52] U.S. Cl. ..... 156/210; 156/314; 156/319; 156/331.9; 427/208.2; 427/341; 427/391; 428/182; 428/186; 428/530

[58] Field of Search ..... 156/205, 206, 208, 210, 156/307.3, 307.5, 307.7, 309.9, 328, 314, 319, 331.9; 427/208.2, 207.1, 208.8, 337, 340, 341, 342, 391, 395, 411; 428/182, 186, 530; 162/136, 164.6

[56] References Cited

U.S. PATENT DOCUMENTS

| | | | |
|---|---|---|---|
| 3,402,068 | 9/1968 | Wilkins | 427/391 X |
| 3,607,598 | 9/1971 | LeBlanc et al. | 428/182 |
| 3,677,868 | 7/1972 | Boggs | 427/391 X |
| 3,687,767 | 8/1972 | Reisman et al. | 156/210 |
| 3,823,028 | 7/1974 | Arian et al. | 428/186 X |
| 3,936,339 | 2/1976 | Lock et al. | 156/205 |
| 4,051,277 | 9/1977 | Wilkinson et al. | 156/210 X |
| 4,379,015 | 4/1983 | Ware et al. | 156/205 |

FOREIGN PATENT DOCUMENTS

| | | |
|---|---|---|
| 0849480 | 8/1970 | Canada . |

*Primary Examiner*—Edward Kimlin
*Assistant Examiner*—Ramon R. Hoch
*Attorney, Agent, or Firm*—Silverman, Cass, Singer & Winburn, Ltd.

[57] ABSTRACT

Uniformly impregnated liner and medium for making corrugated board are prepared by using a urea-aldehyde impregnating composition to impregnate board in-line and a process where the coated board is treated with an aqueous primer and fully cured to provide board having resin free surfaces.

11 Claims, No Drawings

RESIN IMPREGNATED BOARD

This application is a continuation of application Ser. No. 605,662, filed Apr. 30, 1984, now abandoned.

FIELD OF THE INVENTION

This invention relates to a process for producing resin impregnated linerboard suitable for use in the production of corrugated paperboard, the linerboard produced thereby, and the formation of said impregnated linerboard into corrugated paperboard. More particularly, this invention relates to the production of linerboard having a resinous core formed using a penetrating resin solution in conjunction with an aqueous primer so as to produce linerboard substantially free from impregnating resinous material on the outer surfaces thereof.

BACKGROUND OF THE INVENTION

Corrugated paperboard comprises a fluted medium and a linerboard adhesively joined to the tips of the fluted medium on one or both sides thereof. The corrugated paperboard is then cut into sections or into blanks for storage and scored to form containers for shipment of goods.

Various attempts have been made to produce corrugated board having improved wet stiffness properties by impregnating the medium prior to corrugation and assembly of the corrugated board. Likewise, attempts have included resin impregnation of the assembled corrugated board. For example, U.S. Pat. No. 3,823,028 to Arian et al involves pouring liquid impregnating resins into the open ends of finished corrugated boards and allowing the resins to drain out the other side's open ends. Other attempts have been made to employ in-line methods of resin treatment of the board after corrugation, but prior to assembly, as shown in U.S. Pat. No. 3,936,339.

Other processes have not been satisfactory because of the difficulty in producing a uniformly resin-impregnated corrugated medium if resin impregnation is attempted after corrugation. If resin impregnation of medium is performed prior to fluting the impregnated medium, the medium sticks to the corrugating rolls and board cracking is encountered during manufacture of the board.

SUMMARY OF THE INVENTION

It has now been found that resin impregnated linerboard can be produced prior to corrugation having improved uniformity of impregnation of the resinous material, and, in addition, the resulting impregnated board has substantially no resinous material adhering to the surfaces of the board.

The process of the present invention comprises providing an aqueous impregnating composition comprising:

(a) urea-aldehyde resin
(b) a catalyst,
(c) a wetting agent, and
(d) from 0 to about 20 percent of a water soluble solvent which is copolymerizable with said urea-aldehyde resin, and applying this aqueous impregnating composition to at least one surface of a linerboard substrate to form a coating thereon. Next, an aqueous primer is applied to the wet coating of the impregnating composition causing the impregnating composition to be displaced into the linerboard substrate to form a linerboard having a substantially resinous core. The resulting impregnated linerboard is then dried under conditions so as to fully cure the urea-aldehyde polymeric core material to form linerboard having a substantially resinous fiber core. It has now been found that by using the foregoing technique, the aqueous impregnating composition removes the resinous material from the board's surface to such an extent, that the surface is substantially free of urea-aldehyde resin.

Thereafter, the cured linerboard can be subjected to rehumidification and the remoistened impregnated linerboard can then be adhered to the corrugated medium for the production of corrugated board.

DETAILED DESCRIPTION OF THE PREFERRED EMBODIMENTS

The urea-aldehyde resin is preferably a urea-formaldehyde resin, but may also be a phenol-formaldehyde or melamineformaldehyde resin. If urea-formaldehyde is used, a suitable mole ratio of formaldehyde to urea is, for example, from about 1.5 and 2.0 to 1. A preferred form of the urea-formaldehyde resin is available commercially from Borden Chemical Company under the name UF Concentrate (85%). The urea-formaldehyde resin contains 85 percent by weight solids as a urea formaldehyde adduct.

In addition to the urea-formaldehyde resin, the impregnating composition comprises a sufficient amount of a catalyst for use with the urea-formaldehyde resin. Any suitable catalyst may be used for curing the resin. Suitable catalysts include, for example, ammonium chloride, maleic acid, p-toluene sulfonic acid, formic acid, aluminum sulfate, aluminum chloride, and the like.

According to one preferred embodiment of the present invention, the catalyst is a "slow catalyst." In other words, following admixture of the catalyst with the urea-aldehyde resin, the final stages of curing do not take place until after board is impregnated and heated to fully cure the urea-aldehyde resin within the core of the board. Suitable "slow" catalysts which provide delayed curing properties to the resin, include salts of maleic acid, particularly ammonium maleate, half salts of maleic anhydride, succinic acid and fumaric acid. The catalyst is used in amounts of from about 0.3 to about 3.0, preferably from about 0.6 to about 1.5 weight percent of the aqueous impregnating composition.

Suitable wetting agents for inclusion in the aqueous impregnating composition include alkylaryl polyether alcohols, sulfonates and sulfates of the non-ionic, cationic, and anionic form, such as the alkylaryl polyether alcohols of the octylphenyl series. For example, water soluble isooctylphenol-polyethoxyethanol containing 10 mols of ethylene oxide available from Rohm & Haas under the tradename "Triton X-100"; nonyl phenyl ethoxylate available under the trademark "Hyonic NP-120" from the Diamond Shamrock Corporation; and sodium dioctyl sulfosuccinate, available under the tradename "Aerosol OT" available from American Cyanamid Corporation. The wetting agent or surfactant is used in amounts of between about 0.1% and about 2.5%, preferably between about 0.5 and about 1.5 weight percent of the aqueous impregnating composition.

According to another embodiment of the present invention a water soluble solvent is included in the aqueous impregnating composition. Examples of suitable solvents are isopropyl alcohol, acetone, methanol, ethanol and other like water soluble organic solvents. A preferred embodiment lies in the use of a copolymerizable water soluble solvent such as tetrahydrofurfuryl alcohol. The inclusion of the water soluble solvent adds wetting and paper penetrating properties to the resin solution and the use of a copolymerizable solvent reduces the hydrolyzable formaldehyde, accelerates the polymerization of the UF resin and eliminates hazards associated with the evaporation of organic solvents. The use of the copolymerizable solvent is optional and when used, it can be present in amounts of from about 0 to about 20 weight percent, preferably from about 2 to about 10 weight percent of said aqueous impregnating composition.

The aqueous impregnation composition comprising the urea-aldehyde resin contains from about 35 to about 85, preferably from about 60 to about 75 weight percent solids. The preferred liquid carrier is water. However, combinations of water and organic solvents, such as alcohols can be utilized.

The aqueous impregnating composition is applied to the board in amounts sufficient to provide from about 1 to about 7 pounds, preferably from about 3.5 to about 4.5 pounds per thousand square feet of board. The coating of the aqueous impregnating composition and the primer may be accomplished under ambient conditions using the conventional methods and equipment.

After applying the aqueous impregnating composition to the surface of the linerboard substrate, the surface to be impregnated is treated with an aqueous primer to aid in the penetration of the surface by the urea-aldehyde impregnating composition. Suitable priming agents include water, alone, or in admixture with a bonding agent, such as starch, casein, styrenebutadiene copolymer latex, acrylamide polymers, or polyvinyl alcohol. Such materials enhance subsequent bonding of the linerboard to the medium during the corrugating process. Suitable starches for use in an aqueous primer include corn starch, wheat starch, potato starch, and any other amylaceous material. In addition, various starches modified so as to be cationic, anionic, or amphoteric may be used, with amphoteric corn starch being the preferred. Additionally, the material may be a high amylose content starch or a starch derivative such as an enzyme converted, acid modified, or oxidized starch. The aqueous primer may contain from about 1 to about 25 weight percent, preferably from about 2 to about 5 weight percent bonding agent. The viscosity of the aqueous primer utilized for treating the surface of the board should not exceed 2,000 centipoises, preferably from about 100 to about 500 centipoises. Suitable amounts of priming agent include from 0.02 to about 5.0, preferably from about 0.05 to about 2.0 pounds per thousand square feet of board.

Following treatment of the surface of the board with the priming agent, the primed surface may be steam treated. This can be accomplished by passing the primed board through a steam treating zone in which live steam passing from one or more nozzles is applied onto the surface of the board to which the impregnating composition and primer have been applied.

Next, the coated and primed liner is passed to a drying oven to both dry and fully cure the resin system. Suitable drying air temperatures include from about 300° F. to about 550° F. Suitable residence times in the oven include, for example, from about 5 to about 30 seconds, preferably from about 10 to about 15 seconds at a board speed of from about 300 to about 550 feet per minute. The temperature must be adjusted so that the sensible board temperature is 350° to 425° F.

Sufficient primer should be used to penetrate the surface of the board and displace the urea aldehyde resin towards the core leaving substantially no urea-aldehyde resin on the surface of the board. Next, the board is remoistened to provide from about 5 to about 8 weight percent moisture, preferably from about 6 to about 7 weight percent moisture to prepare the board, which is a liner for combining with medium on a corrugator.

The impregnated board at this point consists of a liner having a core of resin fully within the outer surfaces of the liner.

The following example serves to illustrate the invention. The percentages are by weight unless otherwise indicated. In the following example, the liner is being treated at a speed in the range of between about 300 and about 550 feet per minute.

EXAMPLE

An aqueous impregnating composition was prepared by mixing the following ingredients:

| Component | Parts by Weight |
|---|---|
| Urea | 29.85 |
| Water | 25.0 |
| Borden Resin UF 85 | 57.0 |
| Ammonium Maleate | 7.0 |
| Alkylated Aryl Polyether Alcohol Surfactant (Triton X-100) | 0.5 |
| Tetrahydrofurfuryl Alcohol | 6.0 |

The materials shown in the above Table are admixed together to form a coating composition and are applied to a liner by a reverse roll applicator in amounts sufficient to about 0.009 pounds per square foot of liner surface. Water is then applied to the surface of the coated liner serving to carry the urea-formaldehyde resin into the interstices of the liner. The water is applied to the linerboard in the amount of 0.01 pounds per square foot of liner. If desired, a binding agent, such as casein, starch, styrene-butadiene copolymer latex, polyvinyl alcohol, polyacrylamide, or the like can be incorporated into the aqueous priming agent to assist in subsequent binding of the linerboard to the corrugating medium. However, such material is not necessary to the successful impregnation of the linerboard with the resinous composition, since water, alone, is all that is required to assist movement of the resinous composition into the interstices of the linerboard.

The resulting linerboard has substantially no resinous material remaining on the surface of the board which had been coated with the resinous composition.

The linerboard is then passed through a steam treating zone wherein live steam is impinged onto the surface of the linerboard by means of steam jets which provide the steam under pressure. The steam serves to further drive the resin into the liner and also to provide initial curing heat to cure the resin.

Next, the linerboard is passed through an oven to dry the linerboard and cure the urea-aldehyde resin. The oven is operated to provide a board temperature of 450° F. and correlated with the movement of the linerboard therethrough to provide a residence time of 15 seconds. This treatment in the oven serves to dry the linerboard and fully cure the resin.

Both surfaces of the linerboard are substantially free of urea-aldehyde resin, which is incorporated into the core of the board. Since substantially no urea-aldehyde remains on the surface by using the process in accordance with the present invention, the amount of resin that remains on the surface of the linerboard is eliminated to a greater extent than heretofore possible.

The liner is then subjected to a humidification treatment for remoistening the board, and thereafter the board is passed to a corrugator for incorporation into corrugated board.

Although the invention has been described in considerable detail with particular reference to certain preferred embodiments thereof, variations and modifications can be effected within the spirit and scope of the invention as described hereinbefore, and as defined in the appended claims.

What is claimed is:

1. A process for producing a resin impregnated linerboard for use in the production of corrugated board, wherein the surfaces of said resin impregnated linerboard have substantially no resinous material thereon, said process comprising, in sequence, providing an aqueous impregnating composition comprising:

(a) urea-aldehyde resin, (b) a catalyst, (c) a wetting agent, and (d) from 0 to about 20 percent of a solvent, providing a linerboard substrate, applying said aqueous impregnating composition to at least one surface of said linerboard substrate to from a coating thereon, applying an aqueous primer onto said coating of said impregnating composition such that said aqueous primer causes said impregnating composition to permeate said linerboard substrate to provide said linerboard substrate with a substantially polymeric core and having substantially no resinous material on the surfaces thereof, drying said impregnated linerboard under conditions for fully curing said urea-aldehyde resin to provide said linerboard with a substantially solid resinous core and having surfaces substantially free of said urea-aldehyde resin, remoistening said fully cured linerboard, and passing the remoistened linerboard to a corrugator for incorporation into the corrugatated board.

2. The process of claim 1, wherein said urea-aldehyde resin is urea-formaldehyde.

3. The process of claim 1, wherein said catalyst is a slow acting catalyst.

4. The process of claim 3, wherein said catalyst is ammonium maleate.

5. The process of claim 1, wherein said solvent is copolymerizable with said urea-aldehyde resin.

6. The process of claim 5, wherein said solvent is tetrahydrofurfuryl alcohol.

7. The process of claim 1, wherein said aqueous primer contains casein, starch, styrene-butadiene copolymer latex, acrylamide polymer, or polyvinyl alcohol.

8. The process of claim 1, wherein the board is a liner to provide seven percent moisture.

9. The process of claim 1, wherein said priming agent has a viscosity of between about 100 and about 500 centipoises.

10. The process of claim 1, wherein both a liner and corrugating medium are subjected to said process and passed to a corrugator for incorporation into corrugated board.

11. The process of claim 1 wherein said impregnated board is dried by passing it through an oven to provide a board temperature of about 450° F. for a residence time of about 15 seconds.

* * * * *